US008373418B2

(12) United States Patent
Davey

(10) Patent No.: US 8,373,418 B2
(45) Date of Patent: Feb. 12, 2013

(54) SUBSEA ELECTRONIC MODULES

(75) Inventor: Peter John Davey, Weston Super Mare (GB)

(73) Assignee: Vetco Gray Controls Limited, Nailsea, Bristol (GB)

( * ) Notice: Subject to any disclaimer, the term of this patent is extended or adjusted under 35 U.S.C. 154(b) by 200 days.

(21) Appl. No.: 12/827,687

(22) Filed: Jun. 30, 2010

(65) Prior Publication Data

US 2011/0001483 A1 Jan. 6, 2011

(30) Foreign Application Priority Data

Jul. 1, 2009 (GB) ..... 0911395.2

(51) Int. Cl.
*G01R 19/00* (2006.01)

(52) U.S. Cl. ..... 324/366; 324/338; 324/333; 166/336; 340/853.3

(58) Field of Classification Search ..... 361/752; 166/338; 324/366, 333
See application file for complete search history.

(56) References Cited

U.S. PATENT DOCUMENTS

| | | | | |
|---|---|---|---|---|
| 6,422,315 | B1 * | 7/2002 | Dean | 166/339 |
| 6,954,082 | B2 * | 10/2005 | Grillettc | 324/750.02 |
| 7,042,367 | B2 * | 5/2006 | Gardner et al. | 340/853.3 |
| 7,148,812 | B2 * | 12/2006 | Baggs | 340/853.7 |
| 7,261,162 | B2 * | 8/2007 | Deans et al. | 166/336 |
| 7,769,914 | B2 * | 8/2010 | Kim et al. | 710/11 |
| 7,991,940 | B2 * | 8/2011 | Frydman et al. | 710/315 |
| 2004/0175092 | A1 * | 9/2004 | Young et al. | 385/138 |
| 2008/0217022 | A1 * | 9/2008 | Deans | 166/338 |
| 2009/0027844 | A1 * | 1/2009 | Chen et al. | 361/684 |

FOREIGN PATENT DOCUMENTS

| | | |
|---|---|---|
| GB | 2451258 | 1/2009 |
| GB | 2451427 | 2/2009 |
| GB | 2460680 | 12/2009 |
| GB | 2461856 | 1/2010 |

* cited by examiner

*Primary Examiner* — Richard Isla Rodas
(74) *Attorney, Agent, or Firm* — Bracewell & Giuliani LLP

(57) ABSTRACT

A module for use as a subsea electronic module of a subsea well, comprises an input (7) for receiving signals from a sensor arrangement which senses at least one parameter of a well, the module including a plurality of separate, different electronic circuits (9), each of which is selectable to be in communication with said input and each of which is adapted to co-operate with a respective, different form of such a sensor arrangement.

6 Claims, 1 Drawing Sheet

SUBSEA ELECTRONIC MODULES

FIELD OF THE INVENTION

The present invention relates to subsea electronic modules.

BACKGROUND OF THE INVENTION

Environmental conditions in subsea wells, such as hydrocarbon extraction wells, are monitored by pressure and/or temperature sensor arrangements located 'downhole' at the base of the well bore. Such sensor arrangements are manufactured by at least ten separate manufacturers and each requires an electronic card, supplied by the manufacturer, to interface between the electrical output of the sensor arrangement and the Intelligent Well Interface Standardisation (IWIS) standard adopted by the well operator. Such interface cards are typically located within a subsea electronic module (SEM) normally housed within a subsea control module (SCM) mounted on the well Christmas tree. As an alternative, some SEM suppliers house the cards in a separate container, along with the need for additional connectors. Either method requires a tailor-made configuration of an SEM or separate container for a particular installation, dependent on the well operator's preferences for sensor arrangement type and manufacturer, thus resulting in lack of standardisation and addition and costs to supply SEMs. Furthermore, the delivery timescales of manufacturers' cards invariably do not match the delivery requirements of the well system. This invention substantially reduces the need for tailoring SEMs to cater for different sensor arrangements and thus facilitates SEM standardisation, resulting in cost and delivery delay reduction.

SUMMARY OF THE INVENTION

According to the present invention, there is provided a module for use as a subsea electronic module of a subsea well, comprising an input for receiving signals from a sensor arrangement which senses at least one parameter of a well, wherein the module includes a plurality of separate, different electronic circuits, each of which circuits is selectable to be in communication with said input, wherein each of said circuits is adapted to co-operate with a respective form of one of a plurality of different sensor arrangements each of which senses the same at least one parameter of a well.

Preferably, said circuits are carried by a circuit card in the module.

In the following embodiment of the invention, said circuits are or conform to the circuitries of respective ones of different sensor arrangement manufacturers, incorporated as IWIS interface cards on to said circuit card. This permits the use of the different sensor arrangements, thus avoiding having to tailor the SEM to suit just a respective installation, and the use of a circuit card having the standard card format of the SEM.

DESCRIPTION OF EMBODIMENT OF THE INVENTION

SEMs contain a multiplicity of printed circuit electronic cards to implement the electronic control and monitoring of the well and the surface platform to well communication system. The format of the printed circuit cards is typically standardised to facilitate commonality of their mechanical mounting arrangement.

Figure 1:
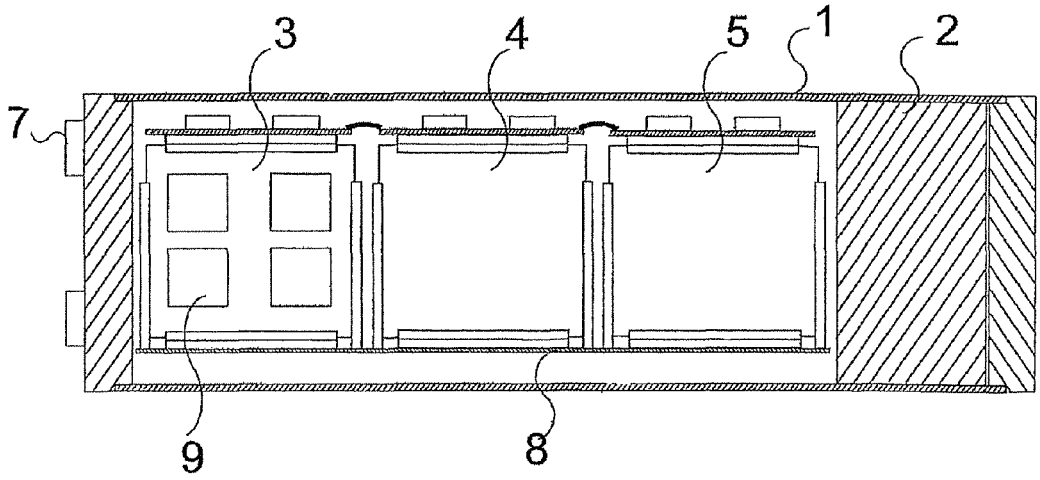
FIG. 1 is a longitudinal sectional view of an SEM incorporating the invention.
Figure 2:
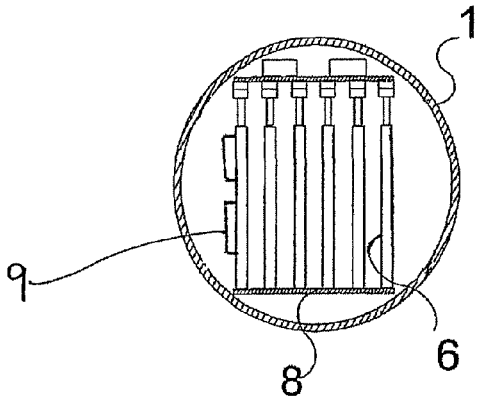
FIG. 2 is a cross-sectional view of the SEM.

FIG. 1 shows schematically a longitudinal sectional view of a typical SEM. The electronics is housed in a sealed cylindrical container 1, with a power supply 2, and typically divided into a number of bays to facilitate standardisation to accommodate various sizes of installation. In this example, three bays 3, 4 and 5 are shown, each accommodating a number of standard format printed circuit cards 6, which communicate with each other and externally through connectors 7 via a printed motherboard 8. FIG. 2 is a cross-sectional view through the bay 3.

Previous catering in an SEM for the pressure and/or temperature sensor arrangement of a particular manufacturer required special mechanical and electrical connection arrangements. This invention allows the standard format of SEM electronic cards to be utilised by the incorporation of sensor circuitries conforming with those of different sensor arrangements and at the same time facilitates standard electrical interconnection (via the motherboard). In the present embodiment, in bay 3, there is a standard SEM card which carries separate electronic circuits 9, each being adapted to conform with a particular, different manufacturer's circuitry, for co-operating with that manufacturer's sensor arrangement, the circuits 9 being selectable to be in communication with such a sensor arrangement in use of the SEM.

Investigation has shown that typically circuits 9 conforming with the circuitries of four different manufacturers can be incorporated on a standard SEM electronic card and in general this is adequate to accommodate most applications.

An alternative to integrating circuits 9 on to a standard SEM board is to fix the manufacturers' circuit boards on to a blank SEM board. In general this is not the preferred arrangement since the assembly costs are greater and the board is likely to take up two board spaces in the SEM board locating rack.

ADVANTAGES OF USING THE INVENTION

1/ Removal of dependency of delivery of sensor cards from various manufacturers.

2/ Removal of the need for the tailoring of SEMs to cater for a variety of sensor arrangements and thus facilitates SEM standardisation, resulting in cost reduction.

The invention claimed is:

1. A subsea electronic module (SEM) for a subsea well, the subsea electronic module comprising:

an input for receiving signals from a sensor arrangement which senses at least one parameter of a well, a plurality of separate, different electronic circuits, each of which circuits is selectable to be in communication with said input, wherein each of said plurality of separate, different electronic circuits is separately configured to co-operate with a different one of a corresponding plurality of different sensor arrangements each of which senses the same at least one parameter of a well, wherein each separate one of said electronic circuits is further configured to receive signals from the respective different cooperating sensor arrangement via the input when the respective cooperating sensor arrangement is operationally employed and in communication with said input.

2. A subsea electronic module according to claim 1, wherein said circuits are carried by a circuit card of the subsea electronic module.

3. A subsea electronic module according to claim 2, wherein said circuits are or conform to the circuitries of respective ones of different sensor arrangement manufacturers, incorporated as IWIS interface cards on to said circuit card.

4. A subsea electronic module (SEM) to provide control functionality for a subsea well, the subsea electronic module comprising:

an input for receiving signals from either of any one of a plurality of different sensor arrangements, each sensor arrangement having a different manufacture configuration, each sensor arrangement functionally configured to sense a same parameter of a well; and a plurality of separate, different electronic circuits configured to cooperate with a corresponding different one of the plurality of sensor arrangements, each of the plurality of separate, different electronic circuits carried on a same circuit card and individually selectable to communicate with the respective cooperating different one of the plurality of sensor arrangements through said input when the respective cooperating sensor arrangement is employed and in communication with said input.

5. A subsea electronic module according to claim 4, wherein each of the plurality of different sensor arrangements is characterized by being configured by a different manufacturer, and wherein each of the plurality of separate, different electronic circuits is configured to conform to the circuitries of the respective cooperating different one of the plurality of sensor arrangements.

6. A subsea electronic module according to claim 5, wherein each of the plurality of separate, different electronic circuits are configured as intelligent well interface standardization (IWIS) interface cards.

* * * * *